US007344194B2

(12) United States Patent
Maier et al.

(10) Patent No.: US 7,344,194 B2
(45) Date of Patent: Mar. 18, 2008

(54) DEVICE FOR LUMBAR SUPPORT

(75) Inventors: Klaus Maier, Dachsberg (DE); Kurt Buntru, Stuehlingen/Eberfingen (DE)

(73) Assignee: Sedus Stoll AG, Waldshut (DE)

( * ) Notice: Subject to any disclaimer, the term of this patent is extended or adjusted under 35 U.S.C. 154(b) by 0 days.

(21) Appl. No.: 11/687,081

(22) Filed: Mar. 16, 2007

(65) Prior Publication Data

US 2007/0216208 A1 Sep. 20, 2007

(30) Foreign Application Priority Data

Mar. 20, 2006 (DE) ..... 10 2006 012 618

(51) Int. Cl.
*A47C 7/46* (2006.01)

(52) U.S. Cl. ..... 297/284.7; 297/284.4

(58) Field of Classification Search ..... 297/284.1, 297/284.4, 284.6, 284.7
See application file for complete search history.

(56) References Cited

U.S. PATENT DOCUMENTS

| | | | | |
|---|---|---|---|---|
| 5,954,399 | A * | 9/1999 | Hong | 297/284.4 |
| 6,079,785 | A * | 6/2000 | Peterson et al. | 297/284.7 |
| 6,260,921 | B1 * | 7/2001 | Chu et al. | 297/284.4 |
| 6,354,662 | B1 * | 3/2002 | Su | 297/284.7 |
| 6,447,062 | B1 * | 9/2002 | Jaekel et al. | 297/284.7 |
| 6,575,530 | B1 | 6/2003 | Fischer et al. | |
| 6,918,634 | B2 * | 7/2005 | Elliot | 297/284.4 |
| 6,957,861 | B1 | 10/2005 | Chou et al. | |
| 7,097,247 | B2 * | 8/2006 | Battey et al. | 297/284.4 |
| 2006/0273643 | A1 * | 12/2006 | McMillen | 297/284.4 |

FOREIGN PATENT DOCUMENTS

| | | |
|---|---|---|
| DE | 101 21 207 A1 | 11/2002 |
| EP | 0 856 269 B1 | 8/2005 |
| FR | 2 556 197 | 6/1985 |

* cited by examiner

*Primary Examiner*—Peter R. Brown
(74) *Attorney, Agent, or Firm*—Oblon, Spivak, McClelland, Maier & Neustadt, P.C.

(57) ABSTRACT

The present invention relates to a device for lumbar support (2) for an office chair with a backrest consisting of a backrest frame with a membrane stretched over it, wherein the device (2) is mounted independently of the membrane in the backrest frame and is adjustable in height as well as horizontally extendable. It is characterized by the following components:

Two carrier elements, identical in construction, each of which exhibits on the outside a lateral guide web (6) and a seating fixture (7) to engage a lumbar slide (8), wherein a spring element (9) is attached to the guide web (6), the spring element (9) being connected to a rigid central element, and wherein the other end of the central component lying opposite the spring element (9) is designed in the shape of a comb and exhibits individual webs, and wherein The two carrier elements, identical in construction, are turned 180° toward each other and are arranged in such a way that the webs of their two central components interlock, and A polyurethane foam element (13) applied on both sides over the central components of the two carrier elements.

3 Claims, 4 Drawing Sheets

DEVICE FOR LUMBAR SUPPORT

TECHNICAL FIELD

The present invention relates to the field of the furniture industry. It relates to a device for lumbar support for an office chair having a backrest comprising a backrest frame with a membrane stretched over it.

STATE OF THE ART

It is known to integrate lumbar-support devices, such as lumbar pillows, into the backrests of office chairs in order to prevent fatigue and tightness of the back musculature, thus preventing the pain this causes in a user of the chair.

The forward curvature of the spine (hollow back) is referred to as lordosis. The named devices for lumbar support are intended to conform to this hollow area as closely as possible.

This is successfully achieved in chairs with an additional backrest pad, because a backrest padded with foam permits placement between the cushion plate and the foam material of a plastic element that can be individually adjusted in height and bulges the pad forward to the position at which it supports the lumbar region of an individual user. The pad itself ensures that the plastic element does not apply pressure. After all, the plastic element is padded just like the rest of the backrest. The pad equalizes the structure to a large extent.

By contrast, a backrest having a membrane stretched over it on one side without a pad structure does not exhibit any padding of the plastic element. Therefore, a device for lumbar support arranged behind or in front of the membrane and incorporated into the backrest frame independently of the membrane presses uncomfortably into the back, even if it is soft or padded. An attempt is made to prevent this according to EP 0 856 269 B1, for example, by pivoting a height adjustable reinforcing element arranged behind the membrane on the backrest frame. The disadvantage of this solution is the effort involved in manufacturing and installing the two lateral swiveling connectors for this reinforcing element, the two lateral swiveling connectors contributing considerably to the cost of the chair.

If, by contrast, the lumbar support is incorporated directly into the membrane, then it moves back with the membrane when a user leans back. The disadvantage of this is that it is nearly without effect regarding relief of stress on the spinal column.

From DE 101 21 207 A1, a device for lumbar support is known for an office chair with a backrest consisting of a backrest frame having a membrane stretched over it on one side, the device being arranged behind the membrane and mounted in the backrest frame independently of the membrane. It is adjustable in height as well as horizontally extendable and consists of a central component having two comparatively rigid carrier elements connected to each other via an elastic element arranged in the center, preferably an elastic band, each exhibiting a guide web on the outside, the carrier elements being arranged with a sliding adjustment in the backrest frame. The front part of the device arranged facing the membrane features a cushion plate with a cushion pad, and the back part of the device is formed from a plastic plate. The cushion plate and the plastic plate are connected by means of a clip connector. This device advantageously supports the lumbar area of a user of this type of chair very effectively on an individual basis on the one hand, and on the other hand, it also has sufficient elasticity so that the pad does not apply pressure. However, an unfavorable aspect is the comparatively high level of effort involved in the manufacturing and assembly, in particular, for sewing the elastic band, and the high cost that this entails.

DISCLOSURE OF THE INVENTION

The present invention attempts to avoid the cited disadvantages of the prior art. It is based on the objective of developing a device for lumbar support for the backrest of a chair having a membrane stretched over it, which can be manufactured easily and inexpensively and nonetheless effectively fulfills its objective, namely, the effective relief of stress on the spinal column to prevent fatigue and tightness of the back musculature.

According to the invention, this is achieved with a device according to the preamble to claim 1, wherein the device comprises the following parts:

a) Two carrier elements, identical in construction, each of which exhibits on the outside a lateral guide web and a seating fixture to engage a lumbar slide, wherein a spring element is attached to the guide web, the spring element being connected to a rigid central component, and wherein the other end of the central component is designed in the shape of a comb and exhibits individual webs, wherein b) The two carrier elements are turned 180° toward each other and are arranged in such a way that the webs of their two central components interlock, and wherein c) The two carrier elements are connected to each other by means of polyurethane foam applied on both sides over their central components.

The advantages of the present invention consist of the fact that the device according to the invention can be manufactured very easily and inexpensively. The carrier elements, identical in construction, can be manufactured as a single piece out of plastic in automated production steps. Costly manual labor, such as the sewing of the elastic element for the solution known from DE 101 21 207 A1, is no longer required. The device for lumbar support is mounted independently of the membrane in the backrest frame and is adjustable in height as well as horizontally extendable by means of the two spring elements and the polyurethane foam. This guarantees effective relief of stress on the spinal column.

It is appropriate if the device for lumbar support is used for an office chair having a backrest frame with a membrane stretched over it on both sides, wherein the device according to the invention is arranged advantageously between the two membranes. A chair designed in such a manner thereby provides an esthetically pleasing impression of filigree.

Furthermore, it is appropriate if the guide web, arranged in a guideway of the backrest frame provided with latches, has a vertical sliding adjustment, and if the device for lumbar support is anchored by means of a snap-in lumbar slide, which is inserted into the seating fixture from the outside. An unintended slippage of the device is prevented therewith.

Moreover, it is advantageous if various material pairings are used, as this will enable an adjustment for the intended loads.

BRIEF DESCRIPTION OF THE DRAWING

An exemplary embodiment of the invention is depicted in the drawing. Shown are.

Only those elements essential for understanding the invention are shown. Identical elements are provided with identical reference numbers.

EXECUTION OF THE INVENTION

The invention is explained in further detail below on the basis of an exemplary embodiment and FIGS. 1 through 5.

Figure 1:
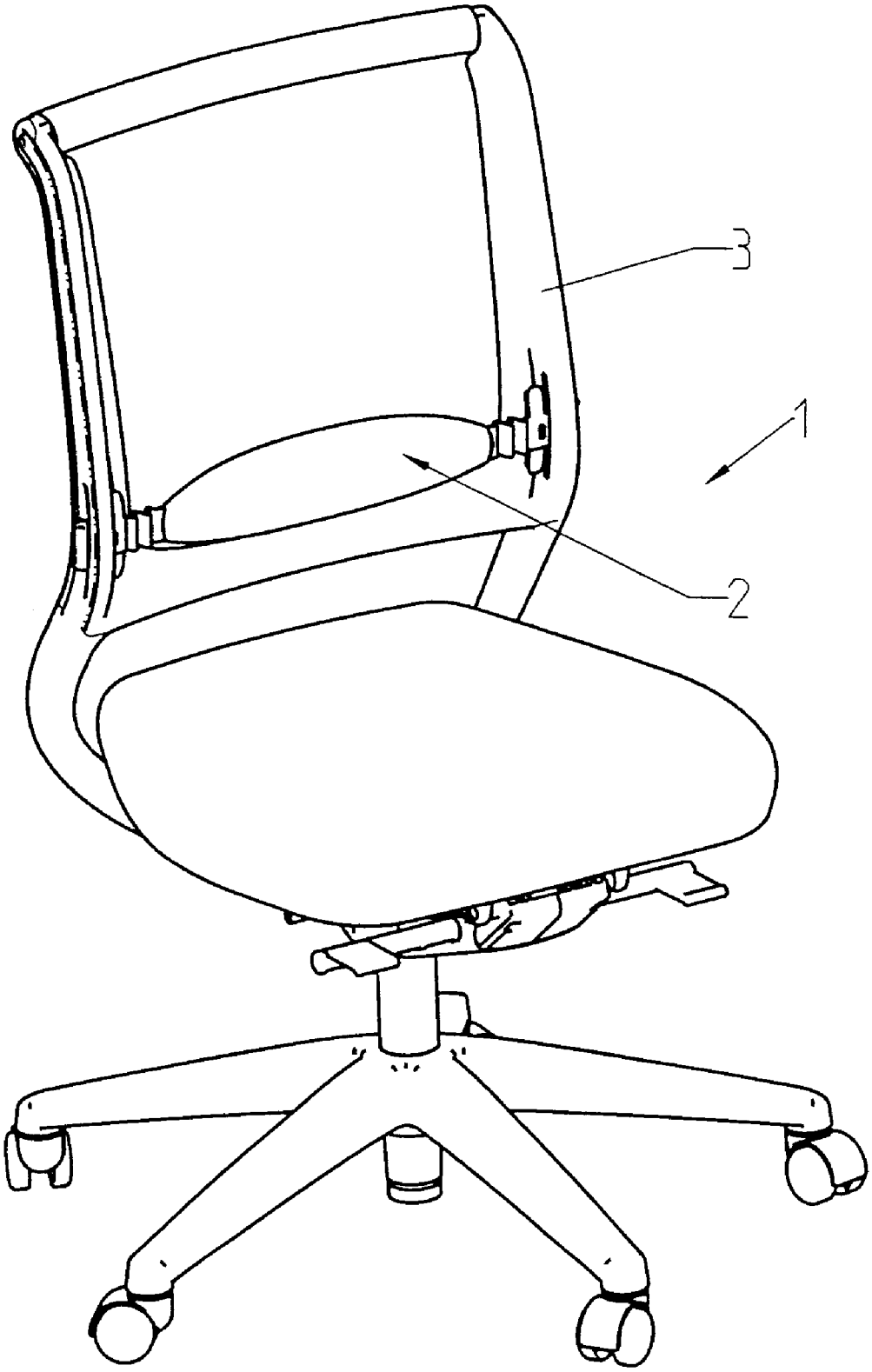
FIG. 1 A perspective view of an office swivel chair with a built-in device for lumbar support according to the invention.

FIG. 1 shows a perspective view of an office swivel chair 1 with a built-in device for lumbar support 2 according to the invention. The office swivel chair 1 has a backrest frame 3, which has a membrane 4 that is not illustrated in FIG. 1 stretched over it on both sides. The device 2 according to the invention is thereby arranged in between the two components of the membrane 4 that is not illustrated in FIG. 1 and independently of it.

Figure 2:
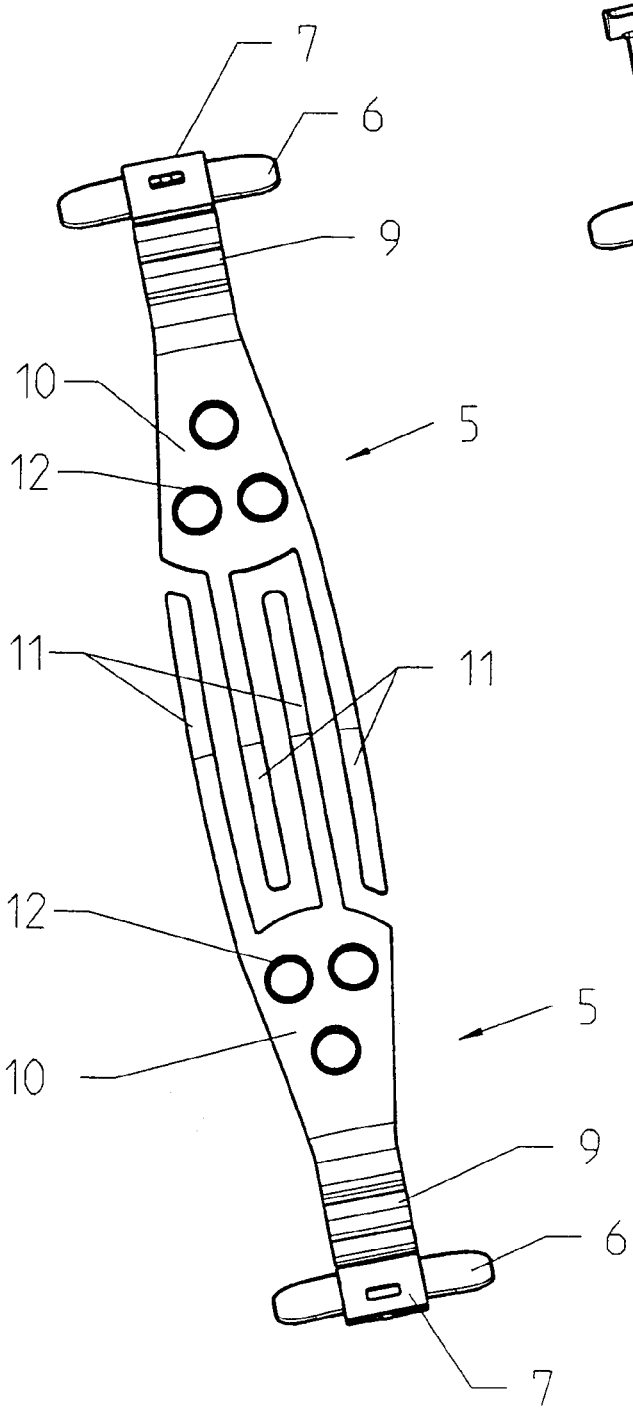
FIG. 2 A top view of the two joined carrier elements of a device for lumbar support according to the invention.
Figure 3:
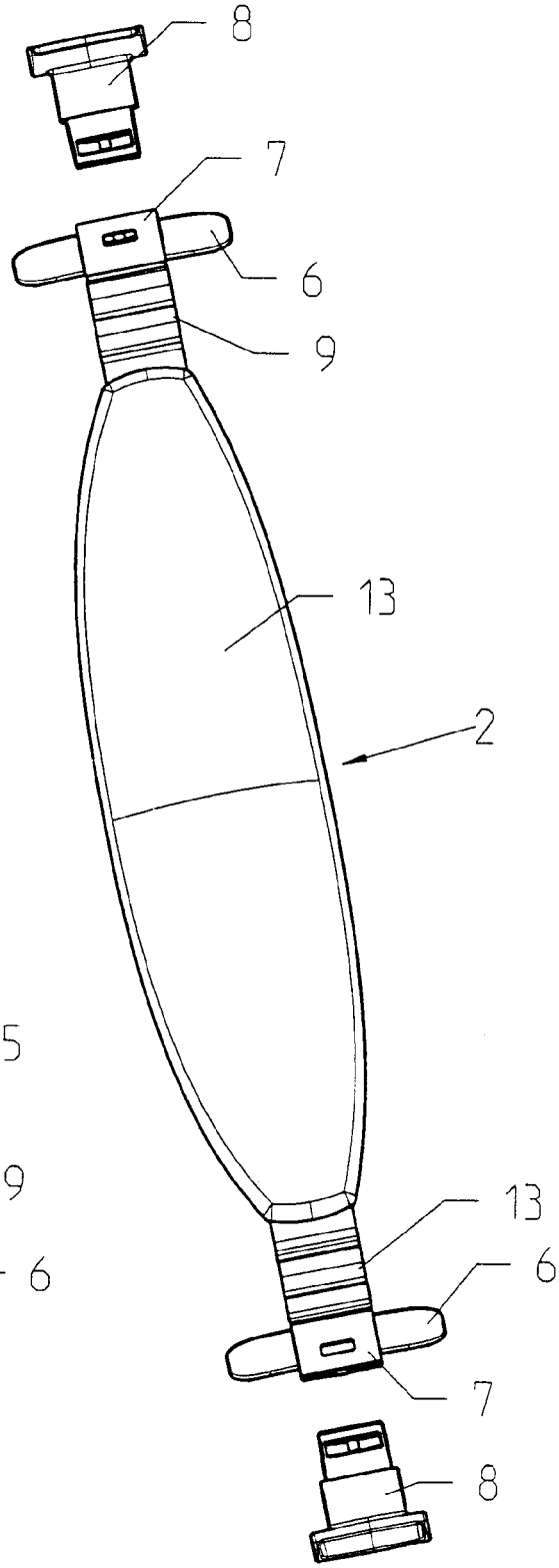
FIG. 3 A top view of a complete device for lumbar support according to the invention.

FIG. 2 shows a top view of one component of the device for lumbar support 2 according to the invention, and FIG. 3 shows a complete top view of the device 2. The device 2 consists of two carrier elements 5, identical in construction, which are manufactured as a single piece out of plastic. The carrier elements 5 each exhibit a lateral guide web 6 on the outside and a seating fixture 7 to engage a lumbar slide 8, wherein a spring element 9 is attached to the guide web 6, the spring element 9 being connected to a rigid central component 10. The central component 10 is designed in the shape of a comb on its other end lying opposite the spring element 9 and therefore exhibits individual webs 11. In the present case, each component has two webs 11. Moreover, several openings 12 are arranged in the central component 10, 3 openings in the present exemplary embodiment, which has a beneficial effect on the stability and elasticity of the carrier elements 5.

The two carrier elements 5, identical in construction, are turned 180° degrees toward each other and arranged in such a way that the webs 11 of their two central components 10 interlock, which is clearly visible in FIG. 2. The two carrier elements 5 are retained by means of polyurethane foam 13 (FIG. 3) applied on both sides over their central components 10. The polyurethane foam element 13 provides a certain necessary elasticity on the one hand, and on the other hand, its form conforms well to the lumbar area of a user of the chair, which improves the supportive effect of the device according to the invention.

Figure 4:
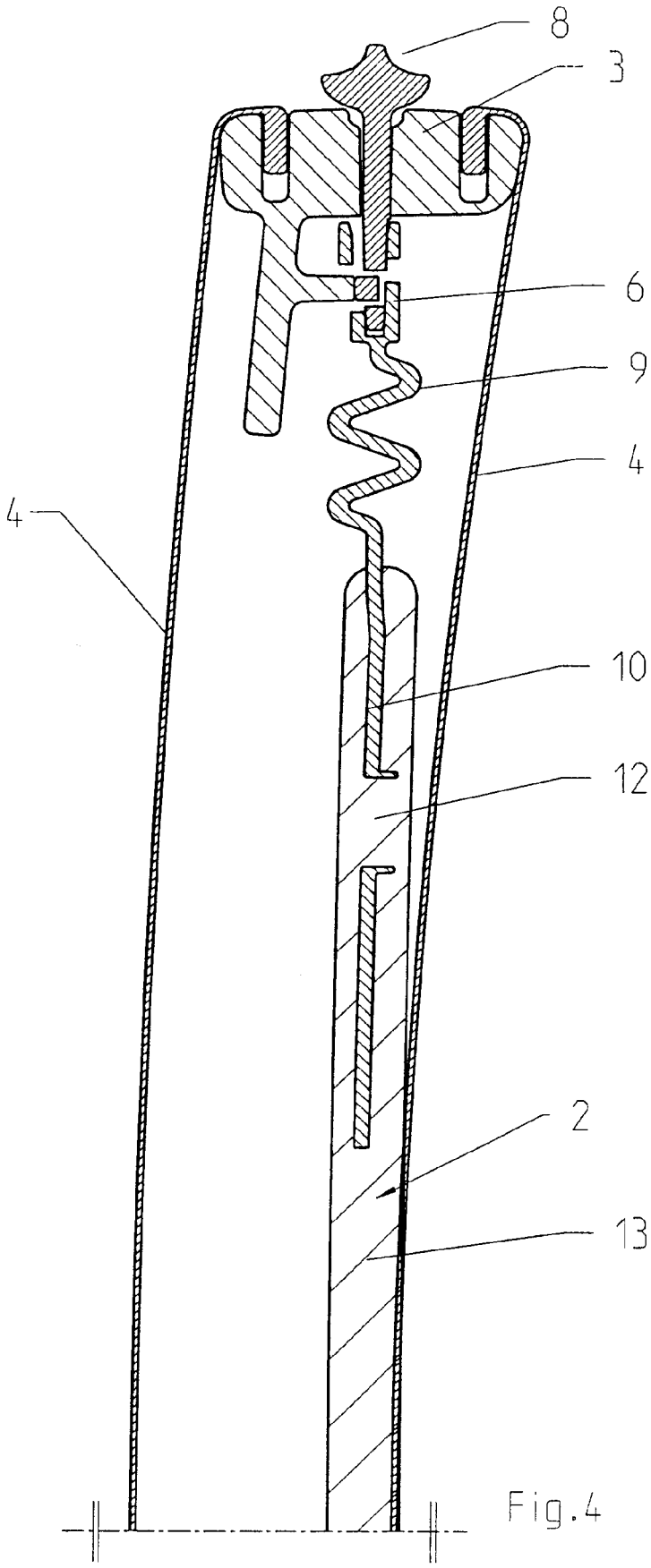
FIG. 4 A partial cross-section of the backrest of the office swivel chair having a membrane stretched over it on both sides with the built-in device for lumbar support according to the invention and FIG. 5 A partial longitudinal section of the backrest of the office swivel chair having a membrane stretched over it on both sides with the built-in device for lumbar support according to the invention.
Figure 5:
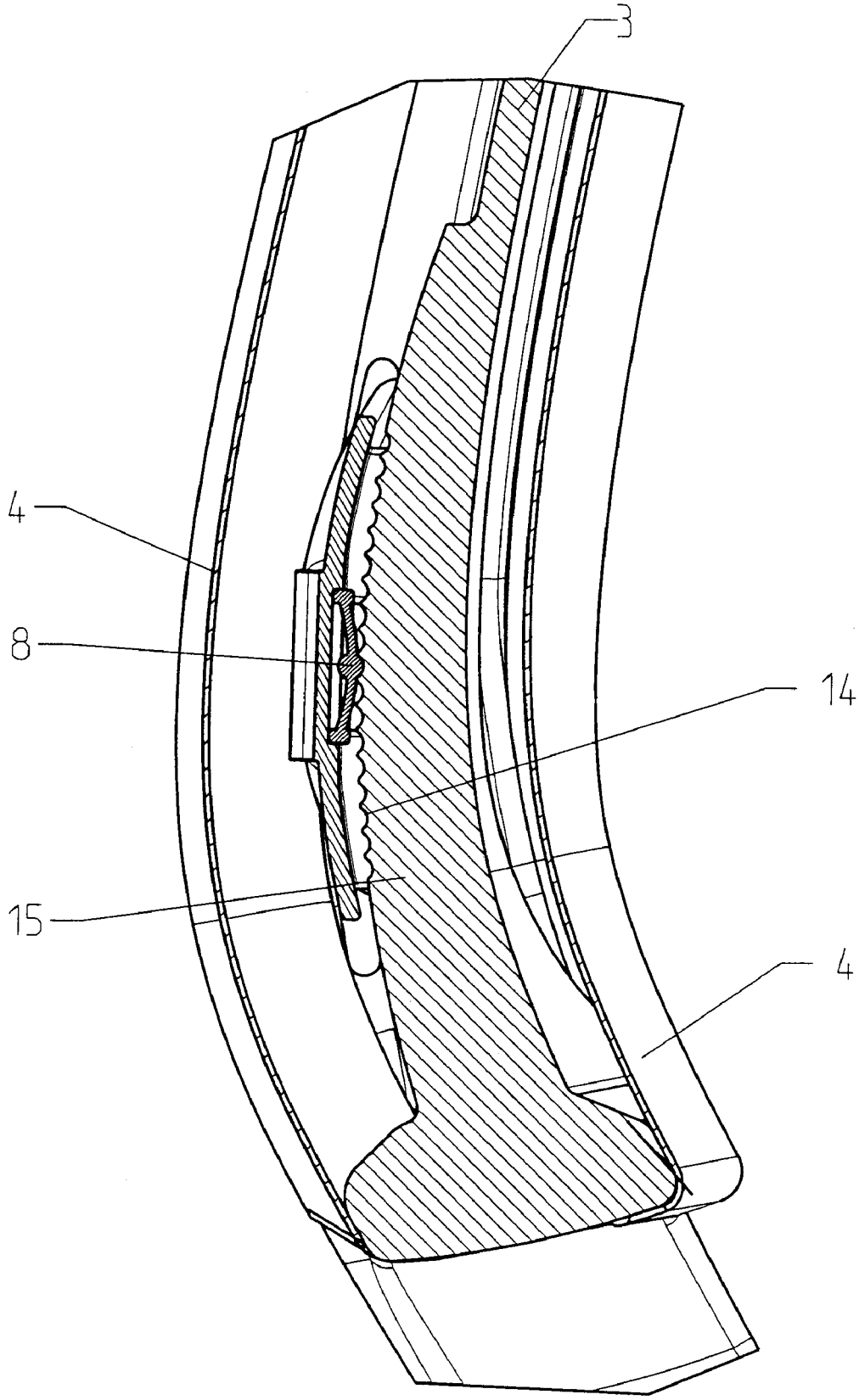

Depicted in FIG. 4 is a partial cross-section, and depicted in FIG. 5 is a partial longitudinal section of the backrest of the office swivel chair 1 having a membrane 4 stretched over it on both sides with the built-in device for lumbar support 2 according to the invention. As is clearly visible in the upper section of FIG. 4, the membrane 4 in the backrest frame 3 of the office chair 1 is affixed by means of membrane piping. Between the front and back membrane 4, the device for lumbar support 2 is arranged in such a way that it is not immediately visible, and the office swivel chair 1 makes an esthetically pleasing impression of filigree. The device for lumbar support 2 is mounted independently of the membrane 4 in the backrest frame 3 and is adjustable in height as well as horizontally extendable by means of the two spring elements 9 and the polyurethane foam 13. This guarantees effective relief of stress on the spinal column of a chair user. The spring elements 9 in the lumbar slides 8 prevent a vertical slippage of the lumbar support.

The guide web 6 of the carrier element 5, arranged in a guideway 15 of the backrest frame 3 provided with latches 14, has an essentially vertical sliding adjustment. The lumbar slide 8 is inserted from the outside into the seating fixture 7 of the carrier elements 5, snaps into place, and anchors the device for lumbar support 2. The device 2 is mounted therewith in the backrest frame 3.

The device according to the invention is easy to manufacture and to operate. Moreover, it is inexpensive. By using various material pairings, an adjustment for various loads can be enabled.

Naturally, the invention is not restricted to the described example embodiment.

| Reference Number List | |
|---|---|
| 1 | Office chair |
| 2 | Device for lumbar support |
| 3 | Backrest frame |
| 4 | Membrane |
| 5 | Carrier element |
| 6 | Guide web |
| 7 | Seating fixture |
| 8 | Lumbar slide |
| 9 | Spring element |
| 10 | Central component |
| 11 | Web |
| 12 | Opening |
| 13 | Polyurethane foam element |
| 14 | Latch |
| 15 | Guideway |

The invention claimed is:

1. A device for lumbar support (2) for an office chair (1) with a backrest consisting of a backrest frame (3) with a membrane (4) stretched over it, wherein the device (2) is mounted independently of the membrane (4) in the backrest frame and is adjustable in height as well as horizontally extendable, characterized in that it comprises the following components:

a) Two carrier elements (5), identical in construction, each of which exhibits on the outside a lateral guide web (6) and a seating fixture (7) to engage a lumbar slide (8), wherein a spring element (9) is attached to the guide web (6), the spring element (9) being connected to a rigid central element (10), and wherein the other end of the central component (10) lying opposite the spring element (9) is designed in the shape of a comb and exhibits individual webs (11), and wherein b) The two carrier elements (5), identical in construction, are turned 180° toward each other and are arranged in such a way that the webs (11) of their two central components (10) interlock, and wherein c) The two carrier elements (5), identical in construction, are connected to each other by means of a polyurethane foam element (13) applied on both sides over their central components (10).

2. A device for lumbar support (2) according to claim 1, characterized in that the guide web, arranged in a guideway of the backrest frame provided with latches, has a vertical sliding adjustment, and the device for lumbar support is anchored by means of a snap-in lumbar slide, which is inserted into the seating fixture from the outside.

3. A device for lumbar support (2) according to claim 1, characterized in that it is implemented for an office chair (1) having a backrest frame (3) with a membrane (4) stretched over it on both sides, wherein the device (2) is arranged between the two membranes (4).

* * * * *